United States Patent [19]

Marzocchi et al.

[11] 4,362,780

[45] Dec. 7, 1982

[54] FIBER REINFORCED MEMBRANE PAVING CONSTRUCTION

[75] Inventors: Alfred Marzocchi, Newark; Richard F. Shannon, Lancaster, both of Ohio

[73] Assignee: Owens-Corning Fiberglas Corporation, Toledo, Ohio

[21] Appl. No.: 147,436

[22] Filed: May 7, 1980

Related U.S. Application Data

[63] Continuation of Ser. No. 903,413, May 8, 1978, abandoned.

[51] Int. Cl.[3] ..... B32B 5/16; B32B 11/02

[52] U.S. Cl. ..... 428/283; 404/17; 428/285; 428/291; 428/325; 428/402; 428/406; 428/489

[58] Field of Search ..... 428/284, 285, 280, 281, 428/291, 298, 302, 489, 402, 403, 406, 283, 288, 325; 404/17, 18, 19, 70; 106/281 R

[56] References Cited

U.S. PATENT DOCUMENTS

| | | | |
|---|---|---|---|
| 2,115,667 | 4/1938 | Ellis | 404/70 |
| 2,311,613 | 2/1943 | Slayter | 106/242 |
| 2,578,883 | 12/1951 | Frick | 106/242 |
| 2,712,506 | 7/1955 | Farris | 106/282 |
| 2,771,387 | 11/1956 | Kleist et al. | 428/285 |
| 2,811,769 | 11/1957 | Craig | 428/392 |
| 3,012,923 | 12/1961 | Slayter | 151/622 |
| 3,062,670 | 11/1962 | Marzocchi et al. | 106/99 |
| 3,144,376 | 8/1964 | Plimberg et al. | 156/62.4 |
| 3,457,136 | 7/1969 | Zaadnoordyk | 106/242 |
| 3,474,625 | 10/1969 | Droper et al. | 404/47 |
| 3,582,367 | 6/1971 | Miller et al. | 106/14.36 |
| 3,615,804 | 10/1971 | Defregger et al. | 106/281 R |
| 3,819,291 | 6/1974 | McConnaughay | 106/282 |
| 3,850,537 | 11/1974 | Bynum | 404/17 |
| 3,870,426 | 3/1975 | Kietzman et al. | 404/82 |
| 3,932,051 | 1/1976 | Cleary | 404/82 |
| 3,965,281 | 6/1976 | Takase et al. | 106/281 R |
| 4,076,885 | 2/1978 | Brossel et al. | 428/489 |
| 4,129,674 | 12/1978 | Hannes et al. | 428/285 |
| 4,135,022 | 1/1979 | Kennepohl | 428/489 |
| 4,146,635 | 3/1979 | Eigenmann | 428/283 |
| 4,175,978 | 11/1979 | Marzocchi et al. | 106/281 R |
| 4,251,586 | 2/1981 | Marzocchi et al. | 428/489 |

*Primary Examiner*—James J. Bell

*Attorney, Agent, or Firm*—Ronald C. Hudgens; Greg Dziegielewski; Harry O. Ernsberger

[57] ABSTRACT

The disclosure embraces a membrane paving construction comprising an asphalt-impregnated body, pelt or mat of fibers, preferably glass fibers, and a method of making same wherein the membrane construction is prefabricated or partially fabricated for use in asphalt paving construction such as paving for highways, bridge decks, driveways, runways, parking lots and the like, as a paving wear surface or for repairing a wear surface or as a membrane construction upon which is superposed a wear surface of asphalt aggregate or the like, the membrane construction being in the form of a rolled-up body or in the form of a thin high density planar board or sheet which may be conveyed in such forms to an installation site and disposed on a substrate in a minimum of time in initial installation of paving or in the repair of asphalt paving.

3 Claims, 9 Drawing Figures

FIBER REINFORCED MEMBRANE PAVING CONSTRUCTION

This is a continuation of application Ser. No. 903,413, filed May 8, 1978, now abandoned.

In the fabrication of paving constructions, such as driveways, runways, parking lots and in repairing asphalt surfaced pavements or highways, bridge decks and the like, it is conventional practice to provide a wear surface of asphalt or to repair an asphalt-surfaced highway, bridge deck, driveway, runway or parking lot, by applying heated asphalt or asphalt aggregate onto the area of the substrate of the construction on which initial surfacing or repair is desired and utilizing roller pressure to smooth the asphalt to provide a wear surface. This method of surfacing a driveway, runway or parking lot or resurfacing an area of a pavement, parking lot, driveway or runway requires considerable time during which the highway, bridge deck, driveway, runway or parking lot is not usable and is blocked to traffic.

The present invention relates to a prefabricated or partially fabricated membrane construction or product which may be applied to a highway, bridge deck, driveway, runway, parking lot and the like either as a wear surface, repair of a wear surface, or as a membrane construction upon which is superposed a wear surface of asphalt, asphalt aggregate or the like.

The invention has for an object the provision of a method or system wherein a membrane construction as paving for a roadway, pavement, bridge deck, driveway, runway or parking lot is prefabricated or partially fabricated and the membrane construction conveyed to a paving site and delivered onto a base or substrate of a roadway, pavement, bridge deck, runway, parking lot, driveway, or the like, wherein the fabricated or partially fabricated membrane construction is laid upon a substrate or upon the repair area of a substrate to be surfaced or resurfaced, the membrane construction being of a character to impede penetration or permeation of moisture or liquids to the substrate or base supporting the membrane construction.

An object of the invention resides in a method or system involving a membrane construction which may be prefabricated or partially prefabricated comprising an asphalt or asphalt aggregate-impregnated body, pelt or mat of fibers for incorporation in paving construction or repair of paving, bridge decks, roadways, parking lots or the like wherein the membrane construction comprises a prefabricated or partially fabricated asphalt-impregnated body, mat or pelt of fibers such as glass fibers or other suitable fibers which impart improved flexural and tensile strengths to the membrane construction as well as to reduce the tendency to cracking or fracturing and minimize or greatly reduce cold flow of the asphalt in the membrane construction.

The invention embraces a prefabricated or partially fabricated membrane construction or product comprising an asphalt-impregnated body, mat or pelt of fibers, such as glass fibers, fusible rock or slag fibers, ceramic fibers or the like, particularly for use in the construction or repair of highways, roadways, bridge decks, runways, parking lots and the like, the membrane construction or product being in the form of a rolled-up package or body or as a thin, high density impregnated planar board-like body or membrane.

Another object of the invention resides in a prefabricated or partially fabricated membrane construction or product comprising an asphalt-impregnated body, mat or pelt of fibers which may be utilized as a wear surface of a paving construction, or as a layer upon which may be disposed a surfacing material or coating of asphalt, asphalt aggregate or the like.

Another object of the invention resides in a method involving a prefabricated or partially fabricated membrane construction for use in paving in which units, sections or sheets of the membrane construction are compacted or semi-compacted during fabrication and transported to the area or site of installation wherein the paving substrate is coated with heated asphalt, the units or sheets being reheated if necessary to render them pliable, the units or sheets then assembled in abutting relation on the asphalt surface and pressure applied to further compact the sheets or layers of the membrane construction to bond the same to the substrate providing a wear surface or upon which may be disposed an asphalt coating as a wear surface.

Another object of the invention resides in a membrane construction for use in paving comprising an asphalt-impregnated body, mat or pelt of random-oriented unbonded fibers and wherein the membrane construction may also contain sulphur, reinforcing textile fibers, glass flake, or fillers such as sand, fine gravel or the like.

Another object of the invention embraces a membrane construction comprising an asphalt-impregnated body, mat or pelt of fibers having a comparatively thin surfacing layer of asphalt containing flake glass.

Further objects and advantages are within the scope of this invention such as relate to the arrangement, method of operation and function of the related elements, to various details of construction and to combinations of parts, elements per se, and to economies of manufacture and numerous other features as will be apparent from a consideration of the specification and drawing of a form of the invention, which may be preferred, in which.

Figure 1:
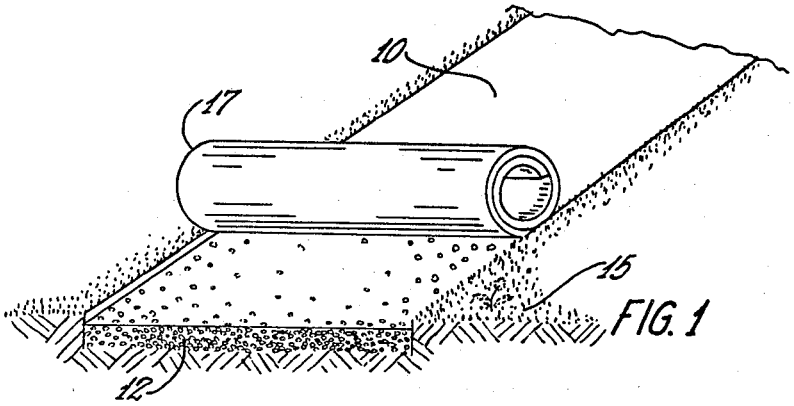
FIG. 1 is a schematic isometric illustration of a form of membrane construction or product of the invention, the view showing one method of installation.

Referring to the drawings, FIG. 1 illustrates a form of the membrane construction or product 10 comprising an asphalt-impregnated pelt, body, mass or mat of unbonded fibers being deposited on a base or substrate 12 of gravel or the like. The substrate is disposed in a suitable depression or recess in the terrain 15. FIG. 1 illustrates a roll 17 of the product 10 partially unrolled upon the substrate or base 12 forming a pavement or paved area.

It is to be understood that FIG. 1 is illustrative of a method of installing a single body, unit or section of the membrane construction or product 10 on the substrate. Several bodies may be disposed on a substrate covering a large area with the several bodies providing paving for highways, bridge decks, driveways, runways, parking lots or the like.

Figure 2:
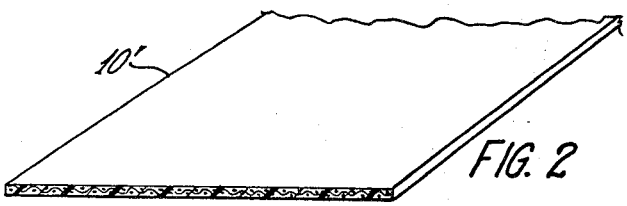
FIG. 2 is an isomeric view illustrating a membrane construction or product of the invention in planar form.

FIG. 2 illustrates a form of the membrane construction or product 10′ comprising an asphalt-impregnated pelt, body or mat of unbonded fibers in a planar or board-like form. As hereinafter described the membrane construction or product 10′ may be fashioned as a semi-rigid flat or planar body which may be deposited in such form on a substrate in forming a paving for highways, bridge decks, driveways, runways, parking lots or the like. The method of forming the membrane construction or product and method of utilizing the product for initial paving or for repairing asphalt surface paving will be hereinafter further described.

Figure 3:
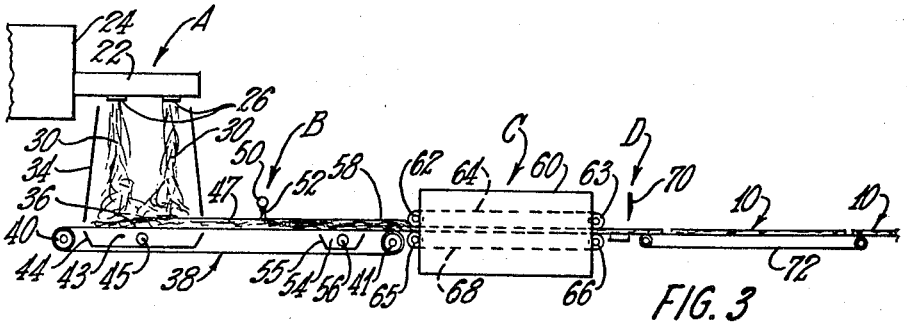
FIG. 3 is a schematic view illustrating a method of forming and processing the membrane construction or product of the invention.

FIG. 3 illustrates schematically one method for forming and processing the membrane constructions or products 10 and 10′. The fibers for the pelt, body or mat may be formed at station "A." While it has been found preferable to utilize fibers of amorphous glass for the body, pelt or mat of the membrane construction, it is to be understood that other fibers such as fibers of fusible rock or slag, ceramic or aluminum silicate fibers may be utilized. The fibers, and particularly if they are glass fibers, may be in the form of staple fiber, textile fibers, continuous filaments or strands of filaments, chopped strands, twisted yarns, roving or the like.

Station "A" exemplifies a method and apparatus for forming fibers of molten glass which include a forehearth 22 connected with a glass melting furnace 24 of conventional construction, the forehearth having a channel receiving molten glass from the melting furnace. The floor of the forehearth may be provided with stream feeders or bushings 26, each having a large number of orifices through which flow streams of the heat-softened glass from the channel in the forehearth 22.

A conventional blower (not shown) for blowing steam or compressed air into contact with the glass streams is associated with each of the stream feeders, the blasts of steam or air attenuating the glass streams to fibers 30 in a conventional manner. It is to be understood that the fibers may be formed by other methods. The fibers 30 are delivered into a forming hood 34 which is open at the bottom. Disposed beneath the forming hood or chamber 34 is the upper flight 36 of an endless type foraminous or reticulated conveyor 38 of conventional construction.

The reticulated endless conveyor 38 is mounted upon rolls 40 and 41, one of which is driven for continuously advancing the upper flight 36 of the conveyor in a right-hand direction. Disposed beneath the upper flight 36 of the endless conveyor 38 and in registration with the forming hood 34 is a suction chamber 43 provided by a receptacle 44. The chamber 43 is connected by a pipe 45 with a suction blower (not shown) of conventional construction for establishing subatmospheric or reduced pressure in the chamber 43.

The fibers 30 are collected upon the upper flight 36 of the conveyor in a loose mass, pelt, body or mat 47, the subatmospheric or reduced pressure in the chamber 43 assisting in the collection of the fibers 30 upon the conveyor flight 36. If desired, an uncured binder or coating material may be delivered by conventional means (not shown) onto the fibers 30 while in the forming hood but the binder is not cured or set so that the mass, body, pelt or mat is of unbonded fibers.

The method includes delivering heat-softened or molten asphalt or asphalt composition onto the mass, pelt or mat 47 of fibers at station "B." Disposed above the upper flight 36 of the conveyor and the collected mass, pelt or mat 47 of fibers is a manifold or dispenser 50 provided with openings or slots in its lower wall. The manifold 50 is connected with a supply of heated liquid or flowable asphalt whereby streams of the liquid asphalt 52 are delivered onto and into the mass, pelt or mat 47 of fibers whereby the flowable or liquid asphalt filters into and throughout the fibers of the mass, body or pelt thus thoroughly impregnating the fibrous mass, pelt or mat with asphalt 52.

Disposed beneath the flight 36 of the endless conveyor 38 and in advance of the roller 41 is a suction chamber 54 provided by a receptacle 55. The chamber 54 is connected by a pipe 56 with a suction blower (not shown) for establishing subatmospheric or reduced pressure in the chamber 54 to enhance the impregnation of the liquid or flowable asphalt throughout the mass, pelt or mat 47 of fibers, the asphalt-impregnated mass, pelt or mat being indicated at 58.

The asphalt constituent of the impregnated mass, pelt or mat 58 is in heated condition and the method includes means for reducing the temperature of or cooling the asphalt-impregnated fibers at a station "C." Disposed at the right-hand of the conveyor supporting roller 41 is a cooling chamber 60 in which a reduced temperature is maintained by circulating cooled gas or air through the cooling chamber 60 or by other cooling means.

Disposed at the ends of the cooling chamber 60 are rolls 62, 63 which support a reticulated endless conveyor 64. Disposed adjacent the respective rolls 62, 63 are rolls 65 and 66 supporting a second endless conveyor 68. The rolls are driven by conventional means (not shown) and the inner flights of the conveyors 64 and 68 engage and compress the asphalt-impregnated mass, pelt or mat 58.

The inner conveyor flights of the conveyors 64 and 68 moving in a right-hand direction convey the asphalt-impregnated fibrous mass, pelt or mat in a right-hand direction through the cooling chamber 60. The rolls 62 and 65 and the rolls 63 and 66 are spaced vertically so that the asphalt-impregnated fibrous mass is compressed to the desired thickness and density by the inner flights of the conveyors 64 and 68 as the impregnated mass or mat moves through the cooling chamber 60.

Under the compressive forces of the conveyor flights the asphalt-impregnated product is compressed and under the influence of the reduced temperature or cooling environment, the asphalt is set or congealed so that the product delivered from the cooling chamber is stabilized of desired thickness and density.

The cooled asphalt-impregnated pelt, mat or body moving away from the cooling chamber 60 is severed or cut at station "D" by a cutting knife or instrumentality 70 into predetermined lengths, units or sections of product 10, the severed units, sections or lengths of the product being conveyed away from the cooling chamber by an endless-type conveyor 72. The units or sections of product 10 may be several feet in length, the length depending upon the method of handling or applying the product as a pavement surfacing medium.

For example, if the product 10 is used for pavement repair surfaces, it may be of shorter lengths than where the product is used as a surfacing media of an initial paving construction. The sections of the product 10 may be rolled up as shown at 17 in FIG. 1 for delivery to the installation site or the sections of the product 10 may be maintained in planar board-like condition as at 10' in FIG. 2 and groups of the product 10' delivered to the installation site in stacked relation.

Figure 4:
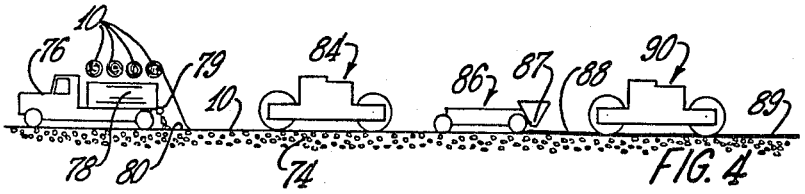
FIG. 4 is a schematic illustration of a method of installation of the membrane construction as a paving.

FIG. 4 schematically illustrates steps in the method of laying or depositing the membrane constructions or products in a paving operation where the membrane constructions or products are conveyed in a rolled condition to the paving site and unrolled as they are laid or deposited on a substrate. The substrate on which the membrane constructions or products are laid or deposited may be a conventional substrate or gravel bed 74.

Several rolls of the product 10 are mounted upon a motor driven conveyance or vehicle 76 of conventional construction, the conveyance being equipped with a tank or container 78 of heated asphalt, asphalt composition or other coating material. The vehicle, moving in a left-hand direction as viewed in FIG. 4, deposits or sprays liquid asphalt or asphalt composition from the tank 78 by a distributor or applicator 79 onto the substrate 74 forming a coating 80 thereon.

During movement of the vehicle, the rolls of the membrane construction or product 10 are successively unrolled onto the coating 80 on the substrate, the ends of the sections or units of the membrane construction or product 10 being in abutting end-to-end relation. A conventional pressure roller 84 successively presses the sections or units of the membrane construction or product 10 into intimate contact with the coating 80 so that the membrane construction or product is adhered to the substrate 74.

Where it is desired to apply a wear coat of asphalt or asphalt composition onto the membrane construction or product 10 on the substrate, a moving instrumentality 86 containing a supply of asphaltic surfacing material delivers the asphaltic surfacing material from an applicator or distributor 87 onto the membrane construction or product providing a coating 88. A second pressure roller 90 of conventional construction presses the surfacing material or coating 88 into contiguous contact with the membrane construction or product 10 providing a wear surface 89 for the paving.

Substantially the same method is employed in laying units or sections of the product 10' shown in FIG. 2 onto a substrate to provide a paving. In such method the planar membrane constructions 10' are arranged in stacked relation on a vehicle such as the vehicle 76 and the planar sheets, units or sections of the product 10' are laid on the substrate in end-to-end abutting relation.

Where the membrane constructions 10 or 10' are utilized as wear surfaces for paving installations, such as parking lots, driveways, runways or the like, the application of an additional wear surface material may be dispensed with.

Figure 5:
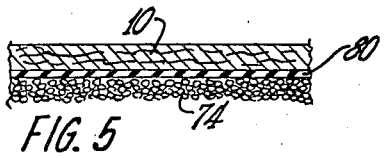
FIG. 5 is a fragmentary sectional view of a paving illustrating the membrane construction of the invention as the wear surface of a paving.

FIG. 5 is a fragmentary sectional view of a paving wherein the wear surface is provided by the membrane construction. In FIG. 5, the substrate or gravel bed 74 is coated with the asphaltic coating or composition 80 and the membrane construction 10 or 10' comprising the asphalt-impregnated pelt, met or body of fibers delivered onto the coating 80 and pressed into the coating by a pressure roller such as the roller 84 schematically shown in FIG. 4.

Figure 6:
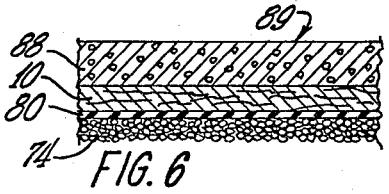
FIG. 6 is a fragmentary sectional view illustrating a paving embodying the membrane construction and a wear surface material disposed on the membrane construction.

FIG. 6 illustrates in cross section the resultant paving construction utilizing the steps illustrated in FIG. 4, the substrate 74 being coated with asphaltic or coating composition 80 on which is disposed a membrane construction 10 or 10'. The coating 88 providing a wear surface may be of asphalt or a composition or aggregate of asphalt, fine gravel, sand or the like.

While the membrane construction comprises basically an asphalt-impregnated body, mat or pelt of glass fibers or other mineral fibers, the membrane or product may contain other constituents or components, such as reinforcing textile or continuous glass fibers, sulphur and a filler such as sand and flaked glass. The sulphur may be added to enhance the stability of the asphalt.

The amounts of constituents in the asphalt-impregnated mat, pelt or body may be varied. It is found that the range of the amount of fibers by weight to asphalt by weight is preferably between fifteen percent and seventy-five percent. Amorphous glass fibers making up the pelt, mat or body weigh about 150 pounds per cubic foot. Asphalt weighs about 60 pounds per cubic foot. If the amount of glass fibers to asphalt is in a fifty percent ratio by weight, the glass per cubic foot of composition will be 78.5 pounds and the weight of asphalt would be 31 pounds per cubic foot.

In a composition of seventy-five percent of glass fibers to twenty-five percent asphalt by weight, the glass fibers in a cubic foot of the composition would be 118 pounds and the asphalt about 15.5 pounds.

If sulphur is added to the composition, it may be in a range of five percent to thirty percent or more by weight based upon the amount of asphalt in the composition. As a typical composition of fifty percent glass fibers, there would be about 78.5 pounds of glass, 26.4 pounds of asphalt and 9.6 pounds of sulphur, a cubic foot of this composition would have a weight of about 114.5 pounds per cubic foot. It is found that if the asphalt content of the composition is increased, then proportionately more sulphur may be used in the composition. Where the composition includes glass flake, the amount of glass flake is in a range of one percent and ten percent by weight.

It is found that if the asphalt-impregnated body, pelt or mat of fibers is too rigid to be satisfactorily unrolled at the installation site, the membrane construction may be semicompacted by the belts 64 and 68 in the cooling chamber during processing, the semicompacted membrane construction may be reheated at the installation site and compacted by the pressure roller to the desired density. It is found that the compacted membrane construction may be of a thickness in a range of from one-eighth inch to five inches depending upon the particular type of paving desired.

Where the membrane construction of the invention is utilized for repairing small areas of paving, the sections or sheets of the membrane construction or product 10 or 10' may be cut to fit the area to be repaired in a paving.

Figure 7:
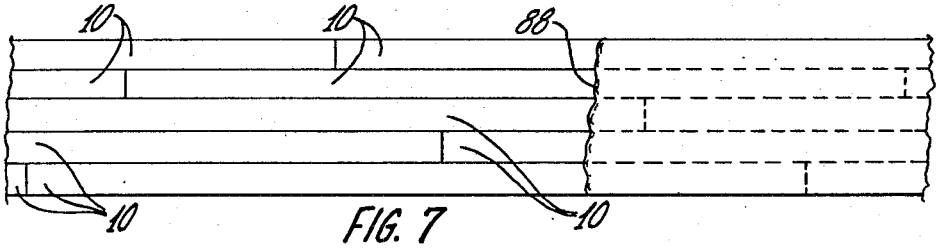
FIG. 7 is a schematic plan view illustrating the assembly of the prefabricated or partially fabricated rolled units, sections or sheets of the membrane construction as a paving.

FIG. 7 illustrates in plan view the orientation of the rolled sections of the membrane construction where the sections are used in initial paving installations or comparatively large repair areas. The sections of the membrane construction 10 which are usually several feet in length may be laid in end-to-end relation on the substrate or base with the abutting ends of the several rows of sections arranged in staggered relation. The wear surface material 88 is distributed over the entire assemblage of membrane constructions or products 10. Any number of rows of membrane constructions may be used depending upon the width desired for the pavement.

Figure 8:
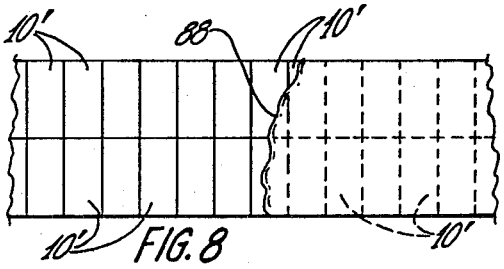
FIG. 8 is a schematic plan view illustrating an assembly of the planar units, sections or sheets of the membrane construction in another type of assembly as a paving.

FIG. 8 illustrates an orientation or arrangement of planar membrane constructions or products 10' wherein they are oriented transversely in two rows as in fashioning a runway, driveway or the like. A surface coating 88 of asphalt may be deposited on the assembled membrane constructions 10'. A parking lot or large area may be covered by utilizing more rows of the membrane constructions or products 10'.

Figure 9:
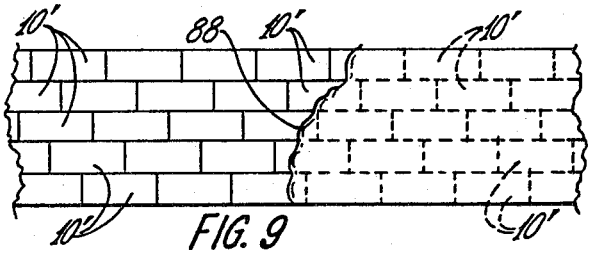
FIG. 9 is a fragmentary plan view illustrating an assembly of preformed flat sheets of the membrane construction as a paving.

FIG. 9 illustrates a modified orientation of sections of membrane constructions or products 10' wherein the rows of sections are disposed lengthwise in end-to-end abutting relation and the sections of adjacent rows having their abutting ends in staggered relation. A coating 88 of asphalt material may be applied over the assembled membrane constructions 10'. As previously mentioned herein the asphalt coating of the membrane construction orientation shown in FIGS. 8 and 9 may be omitted and the surfaces of the sections of membrane construction 10' utilized as wear surfaces.

If desired, a wear surface coating, layer or laminate may be disposed on and adhered to the sections of the asphalt-impregnated fibrous body. Such a layer or laminate is comparatively thin and comprises asphalt containing flake glass. The layer or laminate may be applied to the sections of the asphalt-impregnated fibrous bodies during the process of forming the sections, or the layer or laminate may be applied to the sections at the installation site.

It is apparent that, within the scope of the invention, modifications and different arrangements may be made other than as herein disclosed, and the present disclosure is illustrative merely, the invention comprehending all variations thereof.

We claim:

1. A prefabricated unitary section of membrane construction for use in paving comprising a sheet-like body of unbonded fibers, said body being impregnated with heated asphalt material, flake glass in the impregnated sheet-like body in an amount in a range of one percent and ten percent by weight, said section being cooled to set the asphalt material.

2. A prefabricated unitary section of membrane construction for use in paving comprising a sheet-like body of unbonded fibers, said body of fibers being impregnated with heated asphalt material, a layer of asphalt containing flake glass disposed on and adhered to a surface of the asphalt-impregnated sheet-like body of fibers, said section being cooled to set the asphalt material.

3. A prefabricated unitary section of membrane construction for use in paving comprising a sheet-like body of unbonded glass fibers, said body of fibers being impregnated with heated asphalt material, a layer of asphalt containing flake glass disposed on and adhered to a surface of the asphalt-impregnated sheet-like body of glass fibers, said section being cooled to set the asphalt material.

* * * * *